US005984489A

United States Patent [19]

Rubenstein

[11] Patent Number: 5,984,489

[45] Date of Patent: Nov. 16, 1999

[54] ORNAMENTAL LIGHTING FOR TREES

[76] Inventor: Adam Rubenstein, 644 Indian Trail, Palm Springs, Calif. 92264

[21] Appl. No.: 09/018,645

[22] Filed: Feb. 4, 1998

[51] Int. Cl.[6] ..... F21S 5/00

[52] U.S. Cl. ..... 362/123; 362/249; 362/250; 362/216; 362/219; 362/223

[58] Field of Search ..... 362/122, 123, 362/249, 250, 238, 219, 260, 216, 806, 223, 396

[56] References Cited

U.S. PATENT DOCUMENTS

| | | | |
|---|---|---|---|
| 2,047,045 | 7/1936 | Veenboer | 362/123 |
| 2,478,278 | 8/1949 | Kiesow | 362/123 |
| 3,752,407 | 8/1973 | Baugh et al. | 362/123 |
| 5,410,458 | 4/1995 | Bell | 362/219 |
| 5,743,625 | 4/1998 | Tanner | 362/219 |

*Primary Examiner*—Thomas M. Sember
*Attorney, Agent, or Firm*—Fulwider Patton Lee & Utecht, LLP

[57] ABSTRACT

The lighting assembly uses fluorescent tubes arranged in a circular configuration around a tree, for illumination of the tree and an area around the tree with low power consumption. An outer protective tube is provided around the fluorescent lighting, and an adjustable bracket is provided for mounting the fluorescent lighting and protective tubing assembly to allow the lighting to be adjusted to accommodate a range of tree diameters. Each bracket includes a body with a base portion including a foot member adapted to rest on the tree, with the foot member being slidably attachable to the base portion, for slidably adjusting the lighting system to the diameter of the tree.

16 Claims, 4 Drawing Sheets

ORNAMENTAL LIGHTING FOR TREES

BACKGROUND OF THE INVENTION

1. Field of the Invention

This invention relates generally to electrical lighting, and more particularly concerns ornamental outdoor or indoor lighting for trees.

2. Description of Related Art

Adequate artificial lighting of garden or courtyard areas, poolside areas and walkways can be important for preventing accidents and providing tasteful or even artistic night landscape displays. Individual lights or strings of lights are commonly arranged loosely on branches or hangers attached to a tree such as by screws or nails, string or cord. Spot lights are also often securely mounted on the ground, directed upwardly to illuminate trees and structures from various angles, or can be affixed to a tree to illuminate discrete areas of the tree or around the tree. Full illumination of the tree can be achieved by wrapping a string of lights around a tree trunk and branches, but does not generally provide good area lighting around the tree, and can be degraded by exposure to the elements. To achieve wide area lighting around trees with spot lighting requires multiple spot lights with widely overlapping areas of illumination arranged around the tree, which can result in a high consumption of electrical power to provide suitable area lighting around a tree.

It is desirable to provide a circular lamp and lighting assembly lighting for trees and area lighting around trees that can be arranged in a circular configuration around a tree, without the need for overlapping of individual areas of illumination as is required by spot lighting, and with lower power consumption than is typically required by spot lighting. It would also be desirable to provide an adjustable bracket to allow the circular lamp and lighting assembly to be easily adjusted to accommodate a range of tree diameters. The present invention meets these needs.

SUMMARY OF THE INVENTION

Briefly, and in general terms, the present invention provides for a lighting assembly that uses fluorescent tubes arranged in a circular configuration around a tree, for illumination of the tree and an area around the tree with low power consumption. A transparent or translucent outer protective tube is provided around the fluorescent lighting to allow the lighting to be used outdoors, and an adjustable bracket is provided for holding the fluorescent lighting and protective tubing assembly to allow the lighting to be adjusted to accommodate a range of tree diameters.

The invention accordingly provides for a lighting system for illuminating a tree and an area surrounding the tree. The lighting system includes a light bulb assembly that can be arranged in a circular configuration, typically having a plurality of semicircular light bulb sections, a transparent or translucent protective tube, with a plurality of tube supports disposed in the protective tube, and the light bulb assembly mounted in the protective tube by the plurality of tube supports. In a currently preferred embodiment, the light bulb sections are fluorescent lamps, the outer protective tube is formed of a plurality of semicircular sections of acrylic plastic, and the tube supports are made of silicone.

In a presently preferred aspect, the invention also provides for a plurality of bracket assemblies for mounting the light bulb assembly around a tree. Each bracket assembly includes a body having a base portion, the body defining an aperture in which the circular light bulb assembly is disposed. The bracket assembly also preferably includes a foot member adapted to rest on the tree, the foot member being slidably attachable to the base portion, for slidably adjusting the lighting system to the diameter of the tree. The foot member further preferably comprises a pad portion adapted to rest upon the tree, with one of the foot member and the base portion defining a tongue portion, and the other of the foot member and the base portion defining a groove portion corresponding to the tongue portion to allow adjustment of the position of the bracket base portion on the foot member to accommodate the diameter of the tree. The bracket assembly is currently preferably made of aluminum, with the body having a plurality of cutouts. The foot member further preferably has a set screw disposed on the groove portion adjacent to the tongue portion for securing the base and the foot member together. The bracket assemblies are also typically mounted in a circular configuration around the trunk of the tree to evenly support the circular arrangement of the lighting assembly around the trunk of the tree.

These and other aspects and advantages of the invention will become apparent from the following detailed description and the accompanying drawings, which illustrate by way of example the features of the invention.

DETAILED DESCRIPTION OF THE PREFERRED EMBODIMENTS

While illumination of individual trees such as in a courtyard or garden setting can be achieved by stringing lights around a tree trunk and branches, this does not generally provide good area lighting around the tree, and can be degraded by exposure to the elements. While wider area lighting around trees can be achieved with spot lighting, this can require widely overlapping of areas of illumination of multiple spot lights or other types of lights, that can result in a high consumption of electrical power to provide adequate area lighting, and may not fully illuminate the tree itself.

Figure 1:
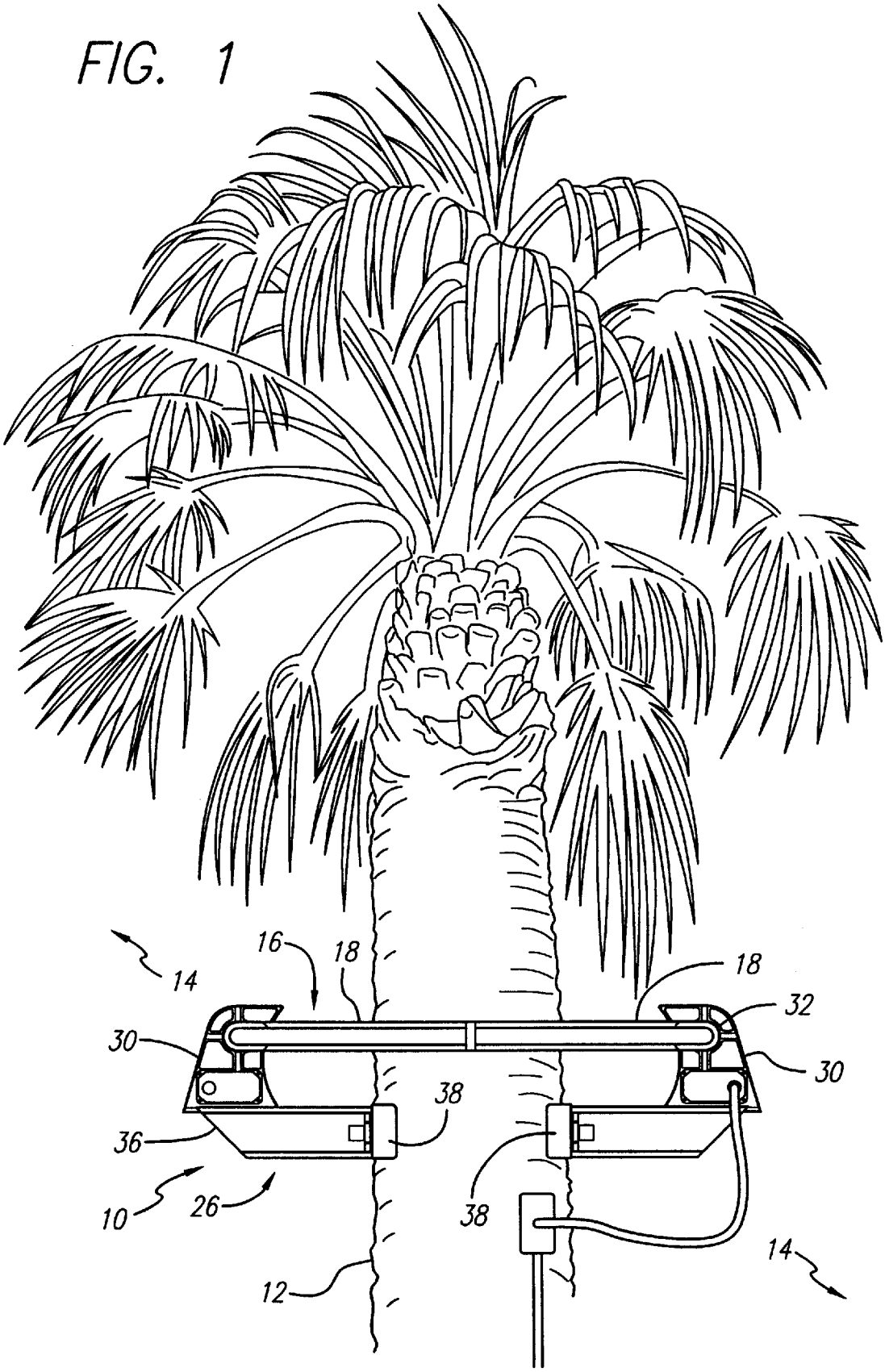
FIG. 1 is a perspective plan view of the lighting assembly of the invention shown in a circular configuration as it would be arranged around a tree trunk.

As is illustrated in the drawings, and particularly referring to FIG. 1, the invention is embodied in a lighting system 10 for illuminating a tree 12 and an area 14 surrounding the tree. The lighting assembly includes a circular light bulb assembly 16, which is one presently preferred embodiment has a plurality of semicircular light bulb sections 18. The light bulb sections preferably are fluorescent light bulb sections, in order to conserve consumption of electrical energy, but other types of lighting, such as incandescent or neon light bulbs, for example, can also be suitable. The lighting assembly is preferably mounted in a circular configuration around the tree, although other configurations can also be suitable, such as to provide decorative shapes of lighting around the tree.

The lighting assembly includes a transparent or translucent protective tube 20, and a plurality of tube supports 22 disposed in the protective tube, the light bulb assembly/sections mounted in the protective tube by the plurality of tube supports 24. The protective tube is preferably made of semicircular sections of acrylic tubing, although glass or other light transmitting plastics could also be used. The tube supports can be ring shaped, for example, and are currently made of silicone, although other elastomeric or plastic materials or the like may also be suitable.

Figure 2:
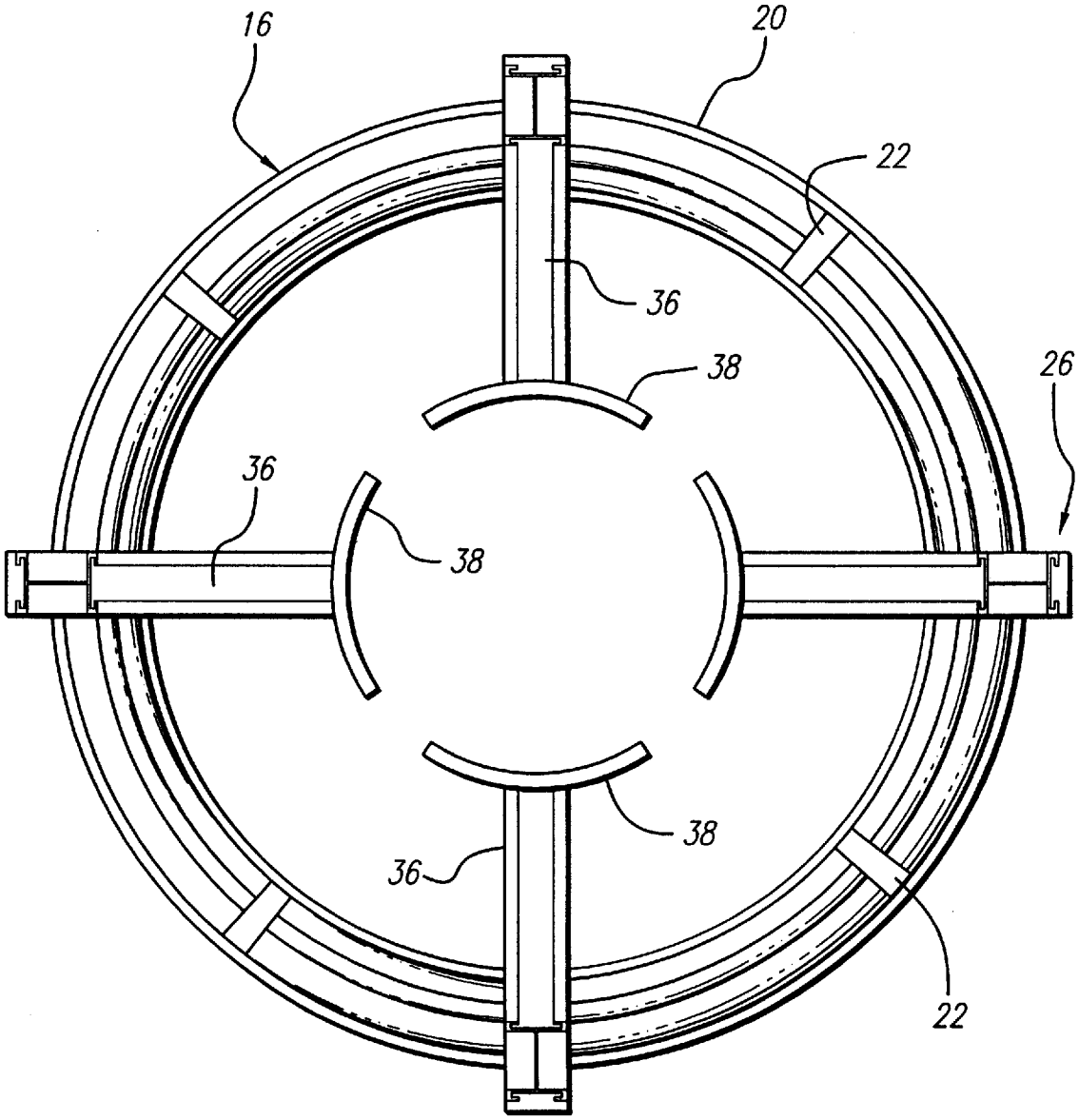
FIG. 2 is a top plan view of the lighting assembly of FIG. 1.
Figure 3:
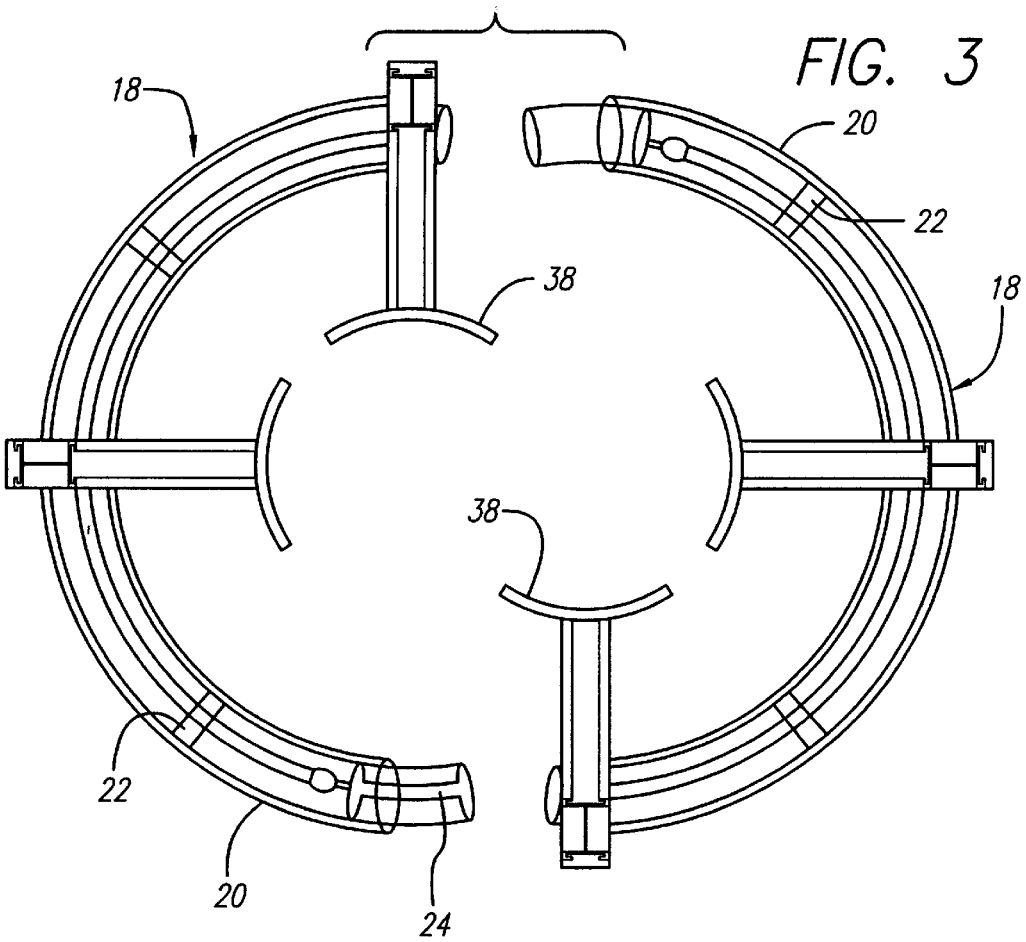
FIG. 3 is an exploded top plan view of a bracket assembly of the lighting assembly of FIGS. 1 and 2.
Figure 4:
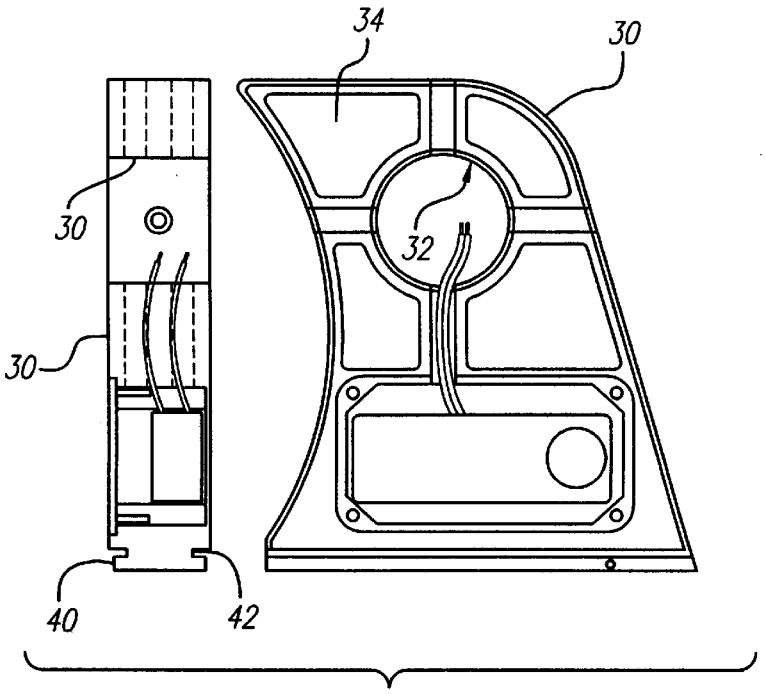
FIG. 4 is a combination end view and side elevational view of the body of the bracket assembly of FIG. 3.
Figure 5:
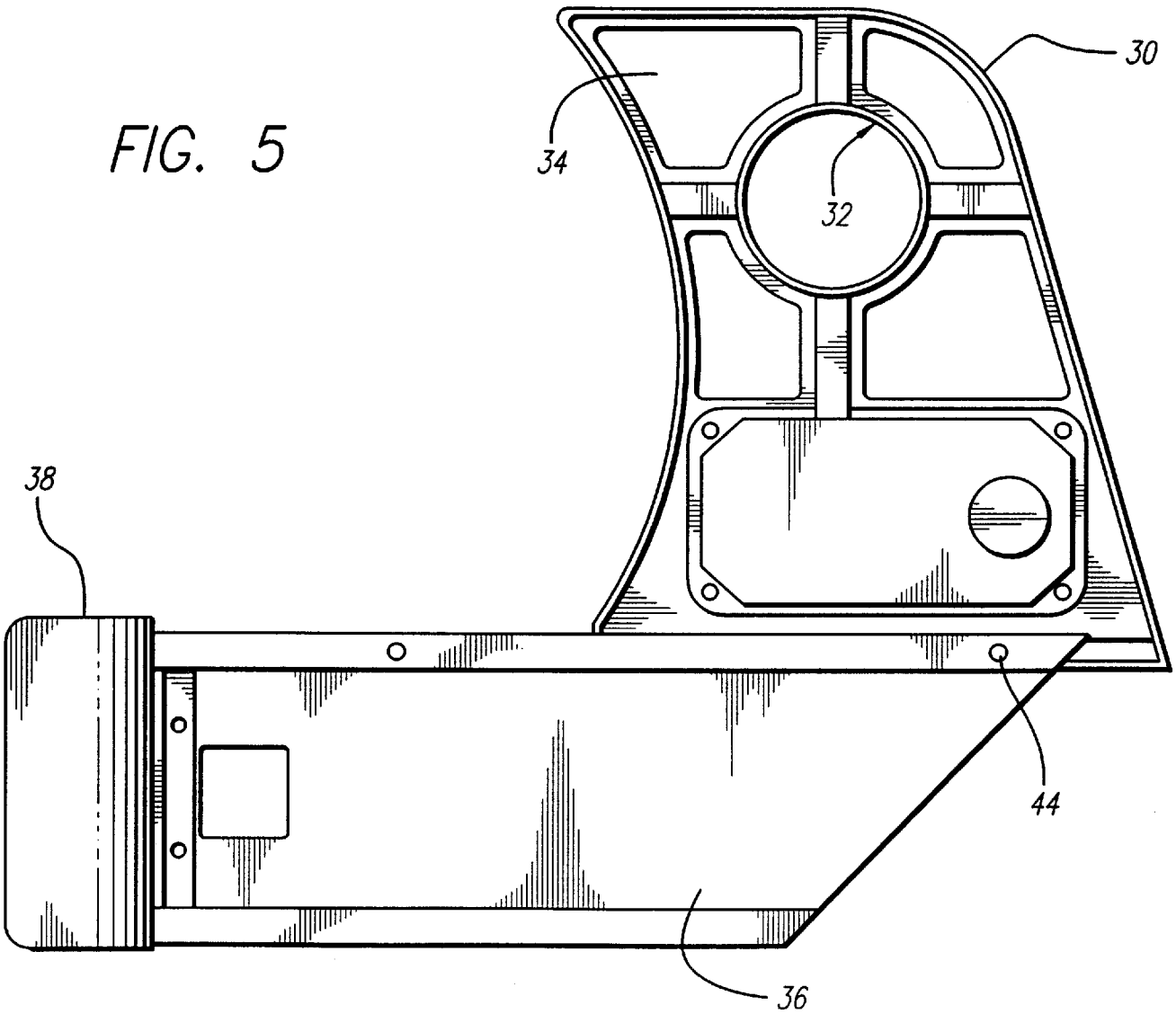
FIG. 5 is a side elevational view of the body of the bracket assembly of FIG. 4 and an attached foot member, which is also shown schematically in section.

The lighting assembly further includes a plurality of bracket assemblies 26 for mounting the protective tube and light sections around the tree. Each bracket assembly preferably includes a body portion 28 having a base portion 30 with an aperture 32 in which the light bulb assembly is disposed. The bracket assembly is currently made of aluminum, but other sturdy lightweight materials such as acrylic or polycarbonate plastic or the like can be used as well. The body typically has a plurality of cutouts 34 for further reducing the weight of the bracket, and further comprises a foot member 36 having a pad portion 38 adapted to rest upon the tree. Advantageously, the foot member is slidably attachable to the base portion, for slidably adjusting the lighting system to the diameter of the tree. As is shown in FIGS. 2 and 3, the base portion preferably has a flange or tongue 40, and the foot portion has a channel or groove 42 for receiving the flange of the base portion in sliding relationship to allow adjustment of the position of the bracket base portion on the foot member to accommodate the diameter of the tree. Alternatively, the foot member can define a tongue portion, and the base portion can define a groove portion corresponding to the tongue portion to allow adjustment of the position of the bracket base portion on the foot member to accommodate the diameter of the tree. A set screw 44 is also preferably disposed on the groove portions of the brackets adjacent to the tongue portion for securing the base and the foot member together.

It will be apparent from the foregoing that while particular forms of the invention have been illustrated and described, various modifications can be made without departing from the spirit and scope of the invention. Accordingly, it is not intended that the invention be limited, except as by the appended claims.

What is claimed is:

1. A lighting system for illuminating a tree and an area surrounding the tree, comprising:

a light bulb assembly; and a plurality of bracket assemblies for mounting said light bulb assembly around the tree, each of said bracket assemblies including a body having a base portion, each of said bracket assemblies further including a foot member adapted to rest on the tree, said foot member being slidably attachable to said base portion, for slidably adjusting the lighting system to the diameter of the tree, and wherein said base portion includes a flange, and said foot portion defines a channel for receiving said flange of said base portion in sliding relationship to allow adjustment of the position of said bracket base portion on said foot member to accommodate the diameter of the tree.

2. The lighting system of claim 1, wherein said light bulb assembly comprises a plurality of semicircular light bulb sections.

3. The lighting system of claim 1, wherein said bracket assemblies are mounted in a circular configuration around the tree.

4. The lighting system of claim 1, wherein said body defines an aperture in which the light bulb assembly is disposed.

5. The lighting system of claim 4, wherein said body has a surface defining a plurality of cutouts.

6. The lighting system of claim 1, further comprising a set screw disposed on said groove portion adjacent to said tongue portion for securing said base and said foot member together.

7. The lighting system of claim 1, wherein said light bulb assembly comprises a plurality of fluorescent light bulb sections.

8. The lighting system of claim 1, further comprising a transparent protective tube and a plurality of tube supports disposed in said protective tube, said light bulb assembly being mounted in said protective tube by said plurality of tube supports.

9. The lighting system of claim 8, wherein said transparent protective tube is formed of a plurality of semicircular sections.

10. The lighting system of claim 8, wherein said tube supports are made of silicone.

11. The lighting system of claim 1, wherein said plurality of bracket assemblies are made of aluminum.

12. A lighting system for illuminating a tree and an area surrounding the tree, comprising:

a light bulb assembly, and a plurality of bracket assemblies for mounting said light bulb assembly around a tree, each of said bracket assemblies including a body having a base portion, each of said bracket assemblies including a foot member adapted to rest on the tree, said foot member being slidably attachable to said base portion, or slidably adjusting the lighting system to the diameter of the tree, and wherein said foot member further comprises a pad portion adapted to rest upon the tree.

13. A lighting system for illuminating a tree and an area surrounding the tree, comprising:

a light bulb assembly having a plurality of semicircular fluorescent light bulb sections;

a transparent protective tube and a plurality of tube supports disposed in said protective tube, said light bulb sections being mounted in said protective tube by said plurality of tube supports;

a plurality of bracket assemblies for mounting said light bulb assembly around the tree, each of said bracket assemblies having a body and a base portion, said base portion including a foot member, said body having a surface defining an aperture in which said light bulb assembly is disposed, said foot member adapted to rest on the tree, said foot member being slidably attachable to said base portion for slidably adjusting said lighting system to the diameter of the tree, one of said foot member and said base portion defining a tongue portion, and the other of said foot member and said base portion defining a groove portion corresponding to said tongue portion to allow adjustment of the position of said bracket base portion on said foot member to accommodate the diameter of the tree.

14. The lighting system of claim 13, wherein said base portion comprises a flange, and said foot portion has a surface defining a channel for receiving said flange of said base portion in sliding relationship to allow adjustment of the position of said bracket base portion on said foot member to accommodate the diameter of the tree.

15. The lighting system of claim 13, further comprising a set screw disposed on said groove portion adjacent to said tongue portion for securing said base and said foot member together.

16. The lighting system of claim 13, wherein said bracket assemblies are mounted in a circular configuration around the tree.

* * * * *

UNITED STATES PATENT AND TRADEMARK OFFICE

CERTIFICATE OF CORRECTION

PATENT NO. : 5,984,489

DATED : Nov. 16, 1999

INVENTOR(S) : Adam Rubinstein

It is certified that error appears in the above-identified patent and that said Letters Patent is hereby corrected as shown below:

Column 2, line 26, after "perspective", delete "plan".

Signed and Sealed this

Eleventh Day of April, 2000

*Attest:*

*Attesting Officer*

Q. TODD DICKINSON

*Director of Patents and Trademarks*